United States Patent [19]

Brown

[11] Patent Number: 4,767,094

[45] Date of Patent: Aug. 30, 1988

[54] BOOK HOLDER

[76] Inventor: Francis Z. Brown, 254 E. Main St., Los Gatos, Calif. 95030

[21] Appl. No.: 36,981

[22] Filed: Apr. 10, 1987

[51] Int. Cl.[4] ..... A47B 97/04

[52] U.S. Cl. ..... 248/448; 248/444.1

[58] Field of Search ..... 248/448, 441.1, 451, 248/460, 444.1; 281/42, 45, 46; 24/67 R, 67.3, 67.9

[56] References Cited

U.S. PATENT DOCUMENTS

| | | | |
|---|---|---|---|
| 1,268,946 | 6/1918 | Farris | 248/448 |
| 1,336,275 | 4/1920 | Boyer | 248/448 |
| 1,576,154 | 3/1926 | Steinman | 248/448 |
| 1,942,716 | 1/1934 | Lotter | 248/448 |
| 3,674,231 | 7/1972 | Lewis | 248/451 |
| 3,701,332 | 10/1972 | Brooks | 281/42 X |
| 3,986,232 | 10/1976 | Teetor | 248/448 X |
| 4,474,383 | 10/1984 | Kikis | 281/45 |
| 4,512,542 | 4/1985 | Black | 248/451 X |

*Primary Examiner*—J. Franklin Foss

*Attorney, Agent, or Firm*—Gerald L. Moore

[57] ABSTRACT

A book holder including a backing strip (24) formed to extend along the covers of an open book (12) with ends (19, 20) bent back toward each other to overlap and clamp open the book pages. A non-skid surface (35) on the backing strip assists in maintaining the holder in place on the open book and on a supporting surface.

3 Claims, 2 Drawing Sheets

BOOK HOLDER

BACKGROUND OF THE INVENTION

1. Field of the Invention

A holder to maintain a book open at a specific page so that it can be read and the pages turned without holding to in the hands.

2. Description of the Prior Art

Frequently when a reader is cooking, eating, or otherwise occupied with the hands, it is desired to maintain a book open at a specific page so that it can be read. Additionally it is desired to be able to turn the pages periodically and without much difficulty. There have been devised various stands on which the book can be placed and which hold it in a tilted attitude so that it can be read. Such stands include tabs which overlap the pages and hold the book open to the desired page. However these stands are somewhat cumbersome to carry around and store and generally are somewhat limited in the size of the book that they will accommodate.

It is the purpose of the present invention to provide a book holder which will maintain the book open to desired pages and which is easily portable and storable.

SUMMARY OF THE INVENTION

A book holder comprising an elongated member having both ends partially folded back toward each other at bend lines spaced slightly further apart than the book width between the edges of the open book such that the book can be opened and the extending page edges inserted between the elongated member and the adjacent folded ends to clamp the pages and hold the book open at the desired page while still allowing the pages to be easily turned.

DESCRIPTION OF A PREFERRED EMBODIMENT OF THE INVENTION

Figure 1:
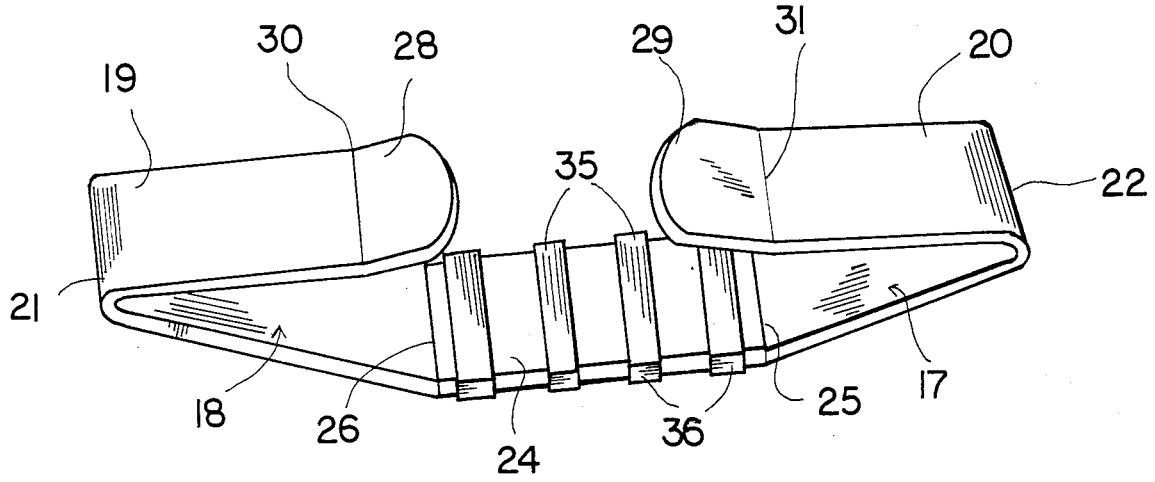
FIG. 1 is a perspective view of a first embodiment of the invention.

The invention is used for the purpose of holding a book 12 (FIG. 2) having pages 14 and a back 15. The holder 17 comprises an elongated planar member 18 having the ends 19 and 20 bent back toward each other at acute angles along fold lines 21 and 22 to form tabs. Thus a backing strip 24 is formed extending between the fold lines 21 and 22. The backing strip also includes secondary fold lines 25 and 26 forming obtuse angles for purposes to be explained later. Additionally the tips 28 and 29 of the tabs 19 and 20 are bent slightly along fold lines 30 and 31 and in a direction away from the backing strip 24.

Figure 2:
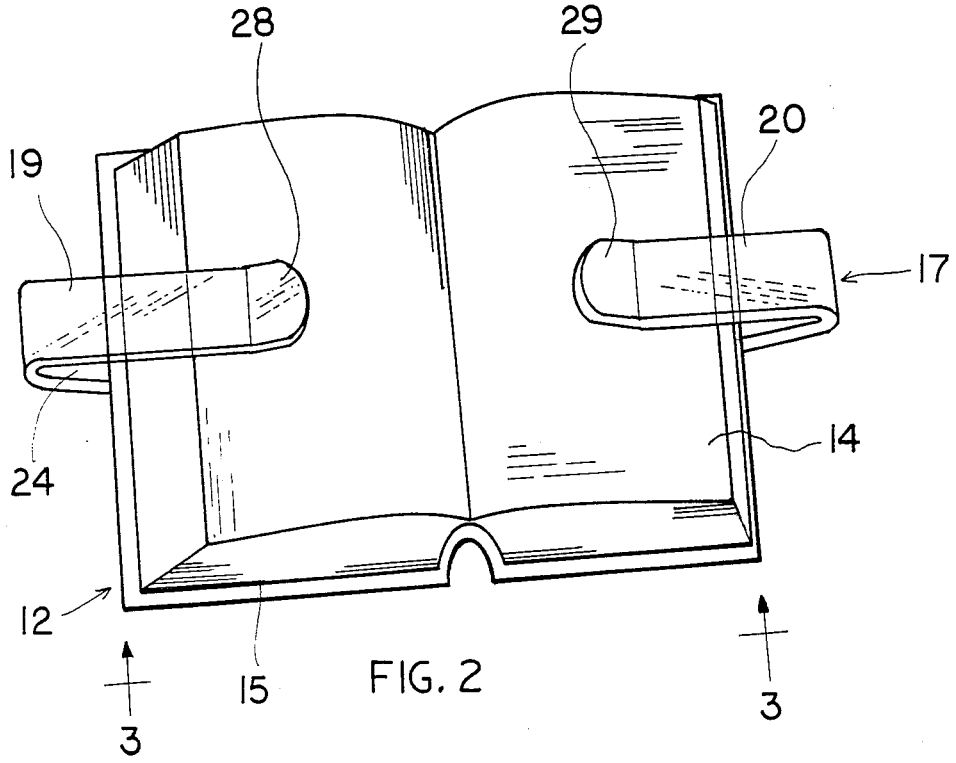
FIG. 2 shows the invention placed on a book for holding the book at a desired page.

In use, the holder is placed over an open book in the manner shown in FIG. 2 with the backing strip 24 extending along the book cover 15 and the tabs 19 and 20 extending around and overlapping the exposed pages 14 of the book. The backing 24 is of sufficient length between the fold lines 21 and 22 to extend beyond the edges of the back of the open book. Thus the tabs 19 and 20 hold the pages 14 to the selected open position. Preferably these tabs are made of transparent material such that the pages can be read therethrough.

To maintain the holder in position on the book, a non-skid surface 35 is formed on the inner surface of the backing strip 24 which in this embodiment takes the form of a plurality of elastic bands 36 extending around the backing strip at spaced positions between the secondary fold lines 25 and 26. This non-skid surface serves to inhibit movement of the holder relative to the book and the holder relative to the surface it is resting upon. The pages of the book can be turned with the holder in place since the tabs 19 and 20 rest primarily on the outside edges of the pages allowing easy insertion or removal of a new page. With the tips 28 and 29 being offset from the plane of the tabs 19 and 20 at the fold lines 30 and 21 the pages can be easily slipped beneath as occurs when the pages are turned. The fold lines 25 and 26 provide sufficient pressure on the pages of a paper back book to allow easy turning through a wide range of book thicknesses.

Preferably the holder is made of a clear semi-flexible material such as polycarbonate so that it is light-weight and yet can be flexed for fitting over the book. With the holder being somewhat planar in configuration it can be used in the book as a bookmark when not used as a book holder.

Figure 3:
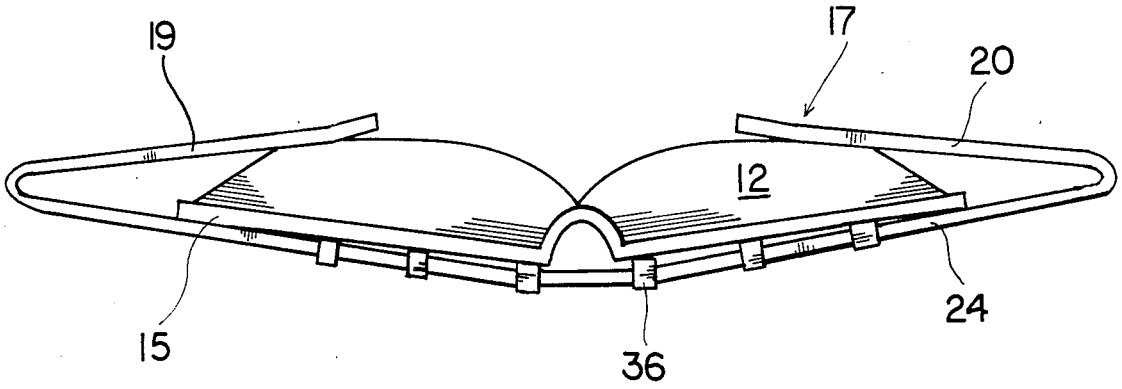
FIG. 3 is a view along the line 3—3 of FIG. 2.
Figure 4:
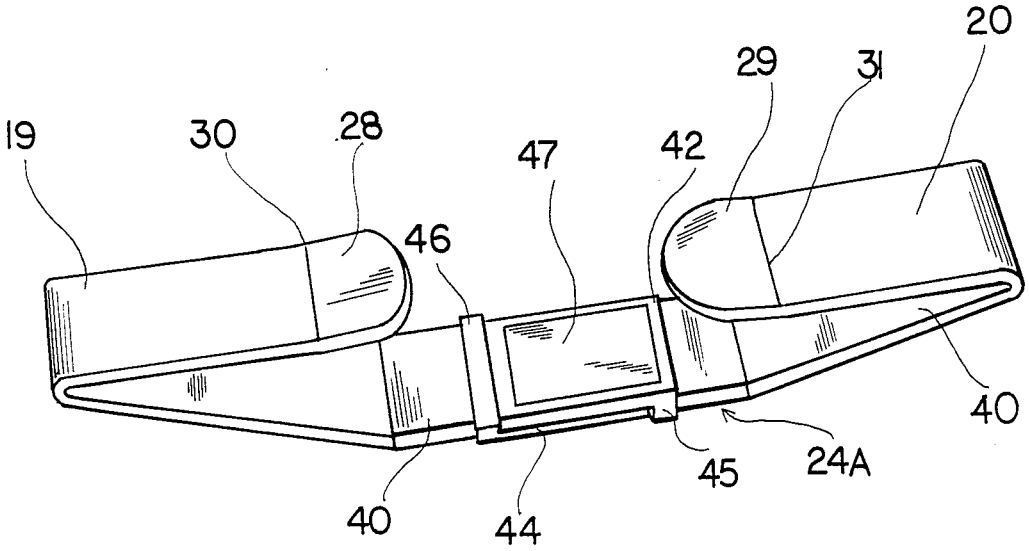
FIG. 4 is a perspective view of a second embodiment of the invention.

In FIG. 2 is shown a second embodiment of the invention comprising a backing strip 24A having tabs 19 and 20 with tips 28 and 29 formed by the bend lines 30 and 31 in the same manner as described relative to Figures 1-3. However the backing strip 24A is comprised of segments 40 and 41 which overlap with the ends 42 and 44 including rigid loops 45 and 46 which extend around the adjacent end. Thus these ends can be adjusted relative to each other to accommodate larger or smaller books and also to make the book holder smaller for easier storage within the book or elsewhere. A non-skid surface 47 is formed on the inner surface of the end 42 preferably by a coating of material to serve the same purpose as the bands 36 of FIG. 1. In all other respects the holder functions in the same manner as a described relative to FIG. 1.

I claim:

1. A book holder comprising:

an elongated member with the ends folded back therealong towards each other at an acute angle with the elongated member and along fold lines spaced apart a distance greater than the width of the opened book to form the tabs such that the book can be placed in said holder with the elongated member extending along the back of the book and the pages held between the member and the tabs with the tabs contacting only the outer edges of the pages, wherein the elongated member is made of a flat planar transparent material, including a non-skid surface on said elongated member.

2. A book holder as defined in claim 1 wherein the ends of said tabs are bent outward slightly from the elongated member to accommodate the sliding of the pages thereunder.

3. A book holder as defined in claim 1 wherein said elongated member includes means to allow an adjustment of the length thereof to fit different sized books.

* * * * *